US007024146B2

(12) United States Patent
Kim et al.

(10) Patent No.: US 7,024,146 B2
(45) Date of Patent: Apr. 4, 2006

(54) FUSING ROLLER OF IMAGE FORMING APPARATUS

(75) Inventors: Hwan-guem Kim, Seoul (KR); Durk-hyun Cho, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/642,759

(22) Filed: Aug. 19, 2003

(65) Prior Publication Data

US 2004/0120741 A1 Jun. 24, 2004

(30) Foreign Application Priority Data

Dec. 20, 2002 (KR) ..... 10-2002-0082008

(51) Int. Cl.
*G03G 15/20* (2006.01)

(52) U.S. Cl. ..... 399/330; 399/333; 219/216

(58) Field of Classification Search ..... 399/330, 399/333; 219/216
See application file for complete search history.

(56) References Cited

U.S. PATENT DOCUMENTS 6,069,346 A * 5/2000 Hyllberg ..... 219/469
6,580,895 B1 * 6/2003 Hirst et al. ..... 399/330

FOREIGN PATENT DOCUMENTS

JP 58016273 A * 1/1983
JP 2000321911 A * 11/2000
JP 2000356922 A * 12/2000
JP 2001265149 A * 9/2001
JP 2001265150 A * 9/2001

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

A fusing roller of an image forming apparatus including an outer metallic pipe, an inner metallic pipe disposed inside the outer metallic pipe, a resistance heating body disposed between the outer and the inner metallic pipes, generating a resistance heat with a power supply, an end cap and a gear cap respectively connected to both ends of the outer metallic pipe and electrically connected to the resistance heating body, an outer insulator interposed between the resistance heating body and the outer metallic pipe to transmit the resistance heat to the outer metallic pipe, and an inner insulator disposed between the resistance heating body and the inner metallic pipe. As a result, the outer insulator has a higher thermal conductivity than that of the inner insulator.

45 Claims, 2 Drawing Sheets

FUSING ROLLER OF IMAGE FORMING APPARATUS

CROSS-REFERENCE TO RELATED APPLICATIONS

This application claims the benefit of Korean Application No. 2002-82008, filed Dec. 20, 2002, in the Korean Intellectual Property Office, the disclosure of which is incorporated herein by reference.

BACKGROUND OF THE INVENTION

1. Field of the Invention

The present invention relates to a fusing roller of an image forming apparatus.

2. Description of the Related Art

A general electrophotographying image forming apparatus using an electrophotographic developing method, such as a photocopier, a laser printer, and the like, has a photosensitive medium that is electrically charged at a predetermined level by a charging means. One method by which the photosensitive medium is electrically charged by the charging means is by exposing the photosensitive medium to a laser beam projected from a laser scanning unit in a predetermined pattern. As a result, an electrostatic latent image is formed on a surface of the photosensitive medium. A developer supplies a toner to the photosensitive medium to thus develop the electrostatic latent image formed on the photosensitive medium to a toner image, which is in a powdery state and visible. Then, when a printing paper passes between a photosensitive drum and a transfer roller rotating in contact with the photosensitive drum, the toner image of the photosensitive medium is transferred to the printing paper. A fusing unit, including a fusing roller, fuses the transferred toner image onto the printing paper with a predetermined pressure and a predetermined temperature. Through this fusing process, the toner image is finally printed on the printing paper. As described above, the fusing unit for fusing the toner image onto the printing paper includes the fusing roller rotating in contact with a backup roller at a high temperature.

Generally, the fusing roller is structured in a manner so that a heat pipe is disposed inside a metallic pipe. An operating fluid contained in the heat pipe is heated by the driving of a resistance heating body, thereby enabling heat to be transmitted to the metallic pipe. This increases the temperature of the metallic pipe to the previously discussed operating temperature within a predetermined time. However, since the heat of the heat pipe disposed inside the metallic pipe is transmitted to the metallic pipe in a non-contacting manner, there is a disadvantage in that it takes a long time to heat the metallic pipe. As a result, the FPOT (First Print Out Time), the delay before the printed image is produced, becomes longer.

In order to solve this problem, there have been recent suggestions of a fusing roller that is capable of directly transmitting heat generated at a resistance heating body to a metallic pipe, so as to heat the metallic pipe within a short time. As for such a fusing roller, there is known in the art a low current/low voltage direct heating instant fusing roller. In this case, the resistance heating body is interposed between an outer metallic pipe and an inner metallic pipe, the inner and outer metallic pipes having different diameters, so that the outer metallic pipe is directly heated by a resistance heat of the resistance heating body. However, an insulator is required for insulation between the resistance heating body and the metallic pipes. An electric insulator, generally having a low degree of heat conduction, deteriorates thermal transmission efficiency, causing the FPOT to increase. Accordingly, improvements in the material and thickness of the electric insulator are required to shorten the FPOT, while still satisfying insulation standards for safety.

SUMMARY OF THE INVENTION

The present invention has been developed in order to solve the above and/or other problems in the related art. Accordingly, an aspect of the present invention provides a fusing roller of an image forming apparatus capable of improving thermal conductivity by decreasing the thickness of the insulation inside the fusing roller and simultaneously obtaining a sufficiently safe insulating property.

The above and/or other aspects are achieved by providing a fusing roller of an image forming apparatus comprising an outer metallic pipe, an inner metallic pipe disposed inside the outer metallic pipe, a resistance heating body disposed between the outer and the inner metallic pipes, generating a resistance heat, an outer insulator interposed between the resistance heating body and the outer metallic pipe to transmit the resistance heat to the outer metallic pipe, and an inner insulator disposed between the resistance heating body and the inner metallic pipe for insulating, wherein the outer insulator has a higher thermal conductivity than that of the inner insulator.

According to an aspect, the outer insulator includes a first insulating sheet and a second insulating sheet that are layered from an outer side of the resistance heating body with a predetermined thickness.

Also, the first and the second insulating sheets are MICA sheets comprised of an artificial MICA and a silicone adhesive.

Also, the first and the second insulating sheets are formed with approximately the same thickness.

Also, the outer insulator further includes a resin film between the second insulating sheet and the outer metallic pipe.

Also, the resin film is a heat resisting polyimide film.

Also, the resin film is thinner than the first and the second insulating sheets.

Also, the resin film is approximately 25 μm in thickness.

Also, the inner insulator includes a first insulating sheet, a second insulating sheet, and a third insulating sheet that are consecutively layered from the resistance heating body toward the inner metallic pipe with a predetermined thickness.

Also, the first, the second, and the third insulating sheets are mica sheets that have approximately the same thickness.

Also, the first, the second, and the third insulating sheets are respectively thicker than the resistance heating body.

Also, the insulating sheets are respectively 0.1 mm to 0.2 mm in thickness and have a withstand voltage of 3.0 kV or greater, and the resin film has a thickness of approximately 25 μm Also, the outer metallic pipe is coated with a synthetic resin so that a coating layer is formed around an outer circumference of the outer metallic pipe.

Also, the coating layer is made of TEFLON.

Also, the outer metallic pipe is approximately 1.0 mm in thickness, and the coating layer is approximately 30 μcm in thickness.

Also, a thermally conductive material is disposed between the insulating sheets.

Also, the thermally conductive material disposed between the insulating sheets is a thermal grease.

Also, the fusing roller of the image forming apparatus further comprises an end cap and a gear cap respectively connected to both ends of the outer metallic pipe and electrically connected to the resistance heating body.

Also, at least one of the end cap and gear cap is provided with a terminal for supplying an AC voltage to the resistance heating body.

Also, an air vent is provided in the end cap for preventing an expansion of the inner metallic pipe due to air pressure in the inner metallic pipe.

Also, at least one of the outer and inner metallic pipes is made of aluminum.

Also, the thickness of the inner metallic pipe is approximately half the thickness of the outer metallic pipe.

Also, the resistance heating body is comprised of either a nickel-chrome or a ferro-chrome.

Also, the resistance heating body is approximately 0.1 mm in thickness.

Additional aspects and advantages of the invention will be set forth in part in the description which follows and, in part, will be obvious from the description, or may be learned by practice of the invention.

BRIEF DESCRIPTION OF THE DRAWINGS

The above and/or other aspects, features, and advantages of the present invention will become more apparent and more readily appreciated by describing in detail a preferred embodiment of the present invention with reference to the accompanying drawings, in which.

DETAILED DESCRIPTION OF THE PREFERRED EMBODIMENTS

Figure 1:
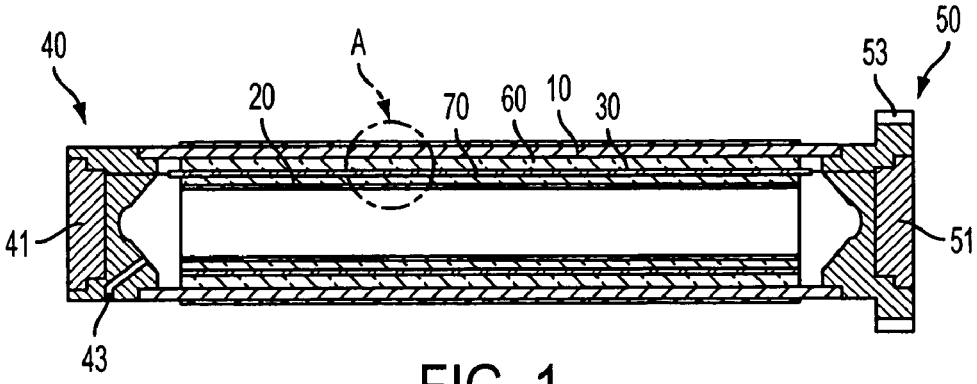
FIG. 1 is a cross-sectional view showing a fusing roller of an image forming apparatus according to an embodiment of the present invention.

Reference will now be made in detail to present preferred embodiments of the present invention, examples of which are illustrated in the accompanying drawings, wherein like reference numerals refer to the like elements throughout. The embodiments are described below in order to explain the present invention by referring to the figures.

Hereinafter, a fusing roller of an image forming apparatus according to an embodiment of the present invention will be described in greater detail with reference to the accompanying drawings.

Referring to FIG. 1, a fusing roller of an image forming apparatus includes an outer metallic pipe 10, an inner metallic pipe 20 disposed inside the outer metallic pipe 10, a resistance heating body 30 interposed between the outer and the inner metallic pipes 10 and 20, generating a resistance heat with a power supply, an end cap 40 and a gear cap 50 respectively connected to both ends of the outer metallic pipe 10, an outer insulator 60 provided between the resistance heating body 30 and the outer metallic pipe 10, and an inner insulator 70 provided between the resistance heating body 30 and the inner metallic pipe 20.

Figure 2:
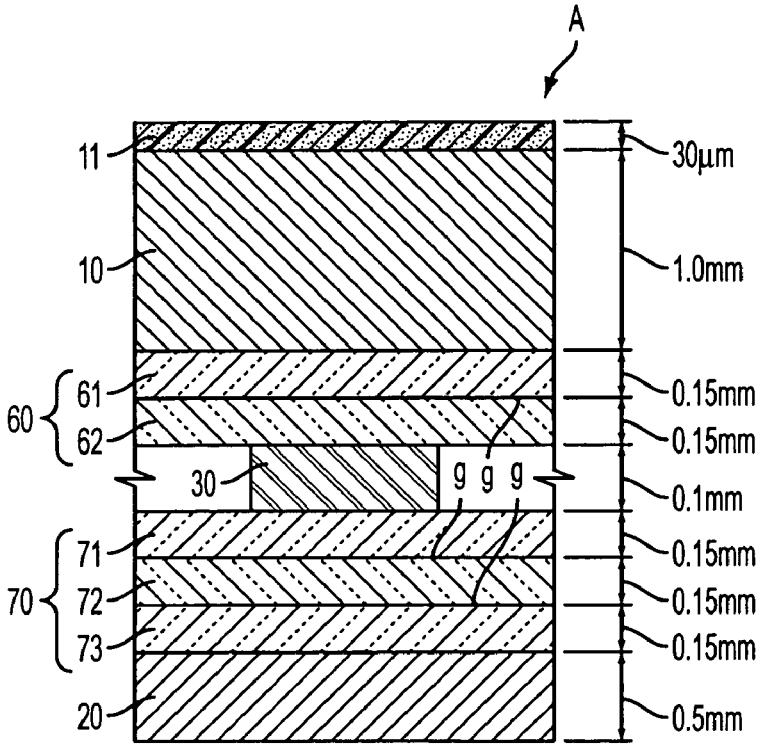
FIG. 2 is a view magnifying the subsection A of FIG. 1.

Referring to FIG. 2, the outer metallic pipe 10 is made of aluminum, having a high thermal conductivity, with a predetermined thickness, and it has both ends opened. The outer metallic pipe 10 is coated with synthetic resin so that a coating layer 11 is formed around an outer circumference of the outer metallic pipe 10. The coating layer 11 may be made of TEFLON® (fluoropolymer resin), which resists heat. The outer metallic pipe 10 is approximately 1.0 mm in thickness. In this case, the coating layer 11 is approximately 30 μm.

The inner metallic pipe 20 is also made of aluminum with a predetermined thickness, and it also has both ends opened. The inner metallic pipe 20 has a smaller diameter than that of the outer metallic pipe 10 so that the inner metallic pipe 20 can be disposed inside the outer metallic pipe 10 and spaced apart from the outer metallic pipe 10 by a predetermined distance. The inner metallic pipe 20 has a thickness corresponding to half of the thickness of the outer metallic pipe 10. For example, in this embodiment, in which the outer metallic pipe 10 has a thickness of 1.0 mm, the inner metallic pipe has a thickness of approximately 0.5 mm.

The resistance heating body 30 is provided in a predetermined thickness sufficient to generate a resistance heat when provided with a power supply. The resistance heating body 30 may be a resistance coil that is made of either a nickel-chrome or a ferro-chrome. The resistance heating body 30 is approximately 0.1 mm in thickness.

The end cap 40 is formed by injection molding with an insulating material and connected to one end of the outer metallic pipe 10. At the outside of the end cap 40 is provided a terminal 41 for supplying an AC voltage to the resistance heating body 30. The terminal 41 is electrically connected to the resistance heating body 30. Also, the end cap 40 is provided with an air vent 43 for preventing expansion of the inner metallic pipe 20 due to air pressure in the inner metallic pipe 20.

The gear cap 50 is formed by injection molding with an insulating material and connected to the other end of the outer metallic pipe 10. At the outside of the gear cap 50 is provided another terminal 51 electrically connected to the resistance heating body 30. Around an outer circumference of the gear cap 50 is provided gear teeth 53 for receiving a driving force from a driving force source through a gear connection.

The outer insulator 60 is to insulate between the resistance heating body 30 and the outer metallic pipe 10. Also, the inner insulator 70 is to insulate between the resistance heating body 30 and the inner metallic pipe 20. Particularly, the outer insulator 60 has a higher thermal conductivity than that of the inner insulator 70. Therefore, a resistance heat generated at the resistance heating body 30 is transmitted to the outer metallic pipe 10 faster than to the inner metallic pipe 20, thus providing a substantially improved FPOT. For this, the outer insulator 60 includes a first insulating sheet 61 and a second insulating sheet 62 that are formed in thickness satisfying predetermined insulation standards (2 kV for U.S. and 3 kV for Europe). The first and the second insulating sheets 61 and 62 are layered between the resistance heating body 30 and the outer metallic pipe 10 with the same thickness. Preferably, the first and the second insulating sheets 61 and 62 are MICA sheets that are comprised of an artificial MICA and a silicone adhesive. Also, the first and the second insulating sheets 61 and 62, while satisfying the insulation standards, each has a thickness ranging from 0.1 mm to 0.2 mm, and thus have a maximum thermal conductivity. It is preferred that the first and the second insulating sheets 61 and 62 are each approximately 0.15 mm in thickness. A test on the two separate insulating sheets 61 and 62, 0.15 mm in thickness, revealed that they have a minimum withstand voltage of 2.18 kV and a maximum withstand voltage of 5.14 kV, which satisfies the aforementioned insulation standards (2 kV and 3 kV). Also, through the test, it was confirmed that there does not occur a dielectric breakdown, even in the case that a leakage current of 5 mA occurs for one minute with a supply of 3.0 kV, of the insulation standard.

The inner insulator 70 has a lower thermal conductivity than that of the outer insulator 60, and it is thicker than the outer insulator 60. The inner insulator 70 includes a third insulating sheet 71, a fourth insulating sheet 72, and a fifth insulating sheet 73 that are consecutively layered from the resistance heating body 30 toward the inner metallic pipe 20 with a predetermined thickness. The third, the fourth, and the fifth insulating sheets 71, 72 and 73 have the same thickness ranging from 0.1 mm to 0.2 mm. Preferably, they are all approximately 0.15 mm in thickness. Also, the third, the fourth, and the fifth insulating sheets 71, 72, and 73 are preferably MICA sheets comprised of an artificial MICA and an adhesive.

Therefore, the inner insulator 70 is made of the same material as that of the outer insulator 60, but it is thicker than the outer insulator 60 and thus has a lower thermal conductivity.

Also, between the first and the second insulating sheets 61 and 62, or between the third, the fourth, and the fifth insulating sheets 71, 72 and 73, coated thermal grease "g" may be present in order to increase thermal transmission efficiency. The thermal grease "g" can prevent an air layer from generating between the insulating sheets. Accordingly, the deterioration of the thermal transmission efficiency caused by the otherwise possible air layer can be prevented.

According to the above-described structure, since the outer insulator 60 is superior in thermal conductivity when compared to the inner insulator 70, the majority of heat produced by the resistance heating body 30 is prohibited from being transmitted to the inner metallic pipe 20, and thus much more heat is transmitted to the outer metallic pipe 10. Accordingly, the temperature of the outer metallic pipe 10 increases more rapidly, thereby minimizing the FPOT.

Also, since the outer insulator 60 is comprised of the first and the second insulating sheets 61 and 62, both having the withstand voltage property satisfying the insulation standards, if any one sheet is damaged, the insulation between the outer metallic pipe 10 and the resistance heating body 30 can be effectively performed by the other insulating sheet. Accordingly, when a high voltage is supplied to drive the resistance heating body 30, it does not flow toward the outer metallic pipe 10, thereby increasing stability.

Figure 3:
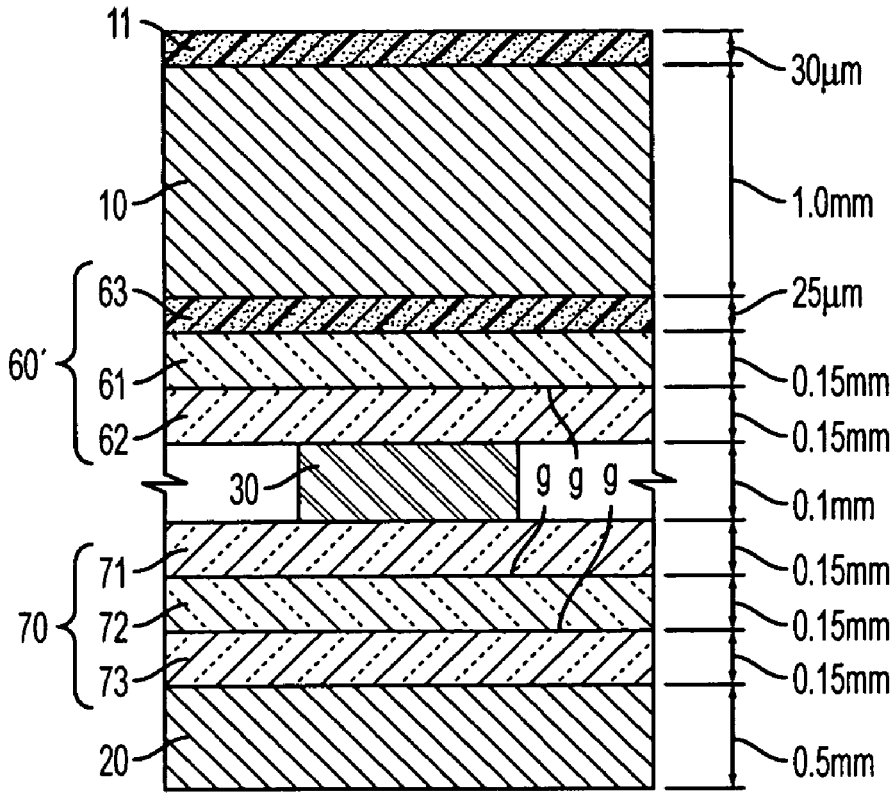
FIG. 3 is a cross-sectional view showing a main part of a fusing roller of an image forming apparatus according to another embodiment of the present invention.

FIG. 3 is a schematic view showing a fusing roller according to another embodiment of the present invention. With respect to elements identical to those of the fusing roller of FIG. 2, like reference numerals are assigned.

Referring to FIG. 3, a fusing roller according to another embodiment is provided with an outer insulator 60' disposed between a resistance heating body 30 and an outer metallic pipe 10. The outer insulator 60' includes a first insulating sheet 61, a second insulating sheet 62, and a resin film 63 laid between the first insulating sheet 61 and the outer metallic pipe 10. The resin film 63 is approximately 25 μm in thickness, and is therefore thinner than the first and the second insulating sheets 61 and 62. Also, it is preferred that the resin film 63 is a heat resisting polyimide film. The resin film 63 has a minimum thickness, so that a sheet of the resin film 63 can satisfy the insulation standards.

According to the fusing roller of the present invention as described above, the majority of the resistance heat generated at the resistance heating body 30 is prohibited from being transmitted inward to the inner metallic pipe of the fusing roller, and is therefore outwardly transmitted in a short time, thereby minimizing the FPOT. Furthermore, the fusing roller can be used safely, as the inner and the outer insulating sheets, while capable of improving the thermal transmission efficiency, also have stable withstand voltage properties.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A fusing roller of an image forming apparatus comprising:

an outer metallic pipe;

an inner metallic pipe disposed inside the outer metallic pipe;

a resistance heating body disposed between the outer and the inner metallic pipes, generating a resistance heat;

an outer insulator interposed between the resistance heating body and the outer metallic pipe to transmit the resistance heat to the outer metallic pipe; and an inner insulator disposed between the resistance heating body and the inner metallic pipe, wherein;

the outer insulator has a higher thermal conductivity than that of the inner insulator, and the outer insulator comprises a first insulating sheet and a second insulating sheet that are layered from an outer side of the resistance heating body with a predetermined thickness.

2. The fusing roller of the image forming apparatus of claim 1 wherein the first and the second insulating sheets are mica sheets comprised of an artificial mica and a silicone adhesive.

3. The fusing roller of the image forming apparatus of claim 1, wherein the first and the second insulating sheets are formed with approximately the same thickness.

4. The fusing roller of the image forming apparatus of claim 1, wherein the outer insulator further includes a resin film between the second insulating sheet and the outer metallic pipe.

5. The fusing roller of the image forming apparatus of claim 4, wherein the resin film is a heat resisting polyimide film.

6. The fusing roller of the image forming apparatus of claim 4, wherein the resin film is thinner than the first and the second insulating sheets.

7. The fusing roller of the image forming apparatus of claim 4, wherein the resin film is approximately 25 μm in thickness.

8. The fusing roller of the image forming apparatus of claim 4, wherein the inner insulator includes a third insulating sheet, a fourth insulating sheet, and a fifth insulating sheet that are consecutively layered from the resistance heating body toward the inner metallic pipe.

9. The fusing roller of the image forming apparatus of claim 8, wherein the third, the fourth, and the fifth insulating sheets are respectively 0.1 mm to 0.2 mm in thickness and have a withstand voltage of 3.0 kV or greater.

10. The fusing roller of the image forming apparatus of claim 4, wherein the first and the second insulating sheets are respectively 0.1 mm to 0.2 mm in thickness and have a withstand voltage of 3.0 kV or greater, and the resin film has a thickness of approximately 25 μpm.

11. The fusing roller of the image forming apparatus of claim 1, further comprising a thermally conductive material disposed between the first and the second insulating sheets.

12. The fusing roller of the image forming apparatus of claim 11, wherein the thermally conductive material is a thermal grease.

13. The fusing roller of the image forming apparatus of claim 1, wherein at least one of the outer and inner metallic pipes is further comprised of aluminum.

14. The fusing roller of the image forming apparatus of claim 1, wherein the resistance heating body is approximately 0.1 mm in thickness.

15. A fusing roller of an image forming apparatus comprising:

an outer metallic pipe;

an inner metallic pipe disposed inside the outer metallic pipe;

a resistance heating body disposed between the outer and the inner metallic pipes, generating a resistance heat;

an outer insulator interposed between the resistance heating body and the outer metallic pipe to transmit the resistance heat to the outer metallic pipe; and an inner insulator disposed between the resistance heating body and the inner metallic pipe, wherein;

the outer insulator has a higher thermal conductivity than that of the inner insulator, and the inner insulator includes a first insulating sheet, a second insulating sheet, and a third insulating sheet that are consecutively layered from the resistance heating body toward the inner metallic pipe with a predetermined thickness.

16. The fusing roller of the image forming apparatus of claim 15, wherein the first, the second, and the third insulating sheets are mica sheets that have approximately the same thickness.

17. The fusing roller of the image forming apparatus of claim 15, wherein the first, the second, and the third insulating sheets are respectively thicker than the resistance heating body.

18. The fusing roller of the image forming apparatus of claim 15, further comprising a thermally conductive material disposed between the first, the second, and the third insulating sheets.

19. The fusing roller of the image forming apparatus of claim 18, wherein the thermally conductive material is a thermal grease.

20. A fusing roller of an image forming apparatus comprising:

an outer metallic pipe;

an inner metallic pipe disposed inside the outer metallic pipe;

a resistance heating body disposed between the outer and the inner metallic pipes, generating a resistance heat;

an outer insulator interposed between the resistance heating body and the outer metallic pipe to transmit the resistance heat to the outer metallic pipe; and an inner insulator disposed between the resistance heating body and the inner metallic pipe, wherein;

the outer insulator has a higher thermal conductivity than that of the inner insulator, and the outer metallic pipe is coated with a synthetic resin so that a coating layer is formed around an outer circumference of the outer metallic pipe.

21. The fusing roller of the image forming apparatus of claim 20, wherein the coating layer is made of a fluoropolymer resin.

22. The fusing roller of the image forming apparatus of claim 20, wherein the outer metallic pipe is approximately 1.0 mm in thickness, and the coating layer is approximately 30 μm in thickness.

23. A fusing roller of an image forming apparatus comprising:

an outer metallic pipe;

an inner metallic pipe disposed inside the outer metallic pipe;

a resistance heating body disposed between the outer and the inner metallic pipes, generating a resistance heat;

an outer insulator interposed between the resistance heating body and the outer metallic pipe to transmit the resistance heat to the outer metallic pipe;

an inner insulator disposed between the resistance heating body and the inner metallic pipe, wherein the outer insulator has a higher thermal conductivity than that of the inner insulator, and an end cap and a gear cap respectively connected to both ends of the outer metallic pipe and electrically connected to the resistance heating body.

24. The fusing roller of the image forming apparatus of claim 23, wherein at least one of the end cap and gear cap is provided with a terminal supplying an AC voltage to the resistance heating body.

25. The fusing roller of the image forming apparatus of claim 23, further comprising an air vent in the end cap, preventing an expansion of the inner metallic pipe due to air pressure in the inner metallic pipe.

26. A fusing roller of an image forming apparatus comprising:

an outer metallic pipe;

an inner metallic pipe disposed inside the outer metallic pipe;

a resistance heating body disposed between the outer and the inner metallic pipes, generating a resistance heat;

an outer insulator interposed between the resistance heating body and the outer metallic pipe to transmit the resistance heat to the outer metallic pipe;

an inner insulator disposed between the resistance heating body and the inner metallic pipe, wherein the outer insulator has a higher thermal conductivity than that of the inner insulator, and a resin film between the outer insulator and the outer metallic pipe.

27. The fusing roller of the image forming apparatus of claim 26, wherein the resin film is a heat resisting polyimide film.

28. A fusing roller of an image forming apparatus comprising:

an outer metallic pipe;

an inner metallic pipe disposed inside the outer metallic pipe;

a resistance heating body disposed between the outer and the inner metallic pipes, generating a resistance heat;

an outer insulator interposed between the resistance heating body and the outer metallic pipe to transmit the resistance heat to the outer metallic pipe; and an inner insulator disposed between the resistance heating body and the inner metallic pipe, wherein;

the outer insulator has a higher thermal conductivity than that of the inner insulator, and the thickness of the inner metallic pipe is approximately half the thickness of the outer metallic pipe.

29. A fusing roller of an image forming apparatus comprising:

an outer metallic pipe;

an inner metallic pipe disposed inside the outer metallic pipe;

a resistance heating body disposed between the outer and the inner metallic pipes, generating a resistance heat;

an outer insulator interposed between the resistance heating body and the outer metallic pipe to transmit the resistance heat to the outer metallic pipe; and an inner insulator disposed between the resistance heating body and the inner metallic pipe, wherein;

the outer insulator has a higher thermal conductivity than that of the inner insulator, and the resistance heating body is comprised of either a nickel-chrome or a ferro-chrome.

30. A fusing roller of an image forming apparatus comprising:

an outer metallic pipe;

an inner metallic pipe disposed inside the outer metallic pipe;

a resistance heating body disposed between the outer and the inner metallic pipes, generating a resistance heat;

an outer insulator interposed between the resistance heating body and the outer metallic pipe to transmit the resistance heat to the outer metallic pipe, wherein the outer insulator comprises a first insulating sheet and a second insulating sheet that are layered from an outer side of the resistance heating body with a predetermined thickness; and an inner insulator disposed between the resistance heating body and the inner metallic pipe, wherein the inner insulator is thicker than the outer insulator.

31. The fusing roller of the image forming apparatus of claim 30, wherein the outer metallic pipe is coated with a synthetic resin so that a coating layer is formed around an outer circumference of the outer metallic pipe.

32. The fusing roller of the image forming apparatus of claim 30, further comprising an end cap and a gear cap respectively connected to both ends of the outer metallic pipe and electrically connected to the resistance heating body.

33. The fusing roller of the image forming apparatus of claim 30, wherein the resistance heating body is approximately 0.1 mm in thickness.

34. A fusing roller of an image forming apparatus comprising:

an outer metallic pipe;

an inner metallic pipe disposed inside the outer metallic pipe;

a resistance heating body disposed between the outer and the inner metallic pipes, generating a resistance heat;

an outer insulator interposed between the resistance heating body and the outer metallic pipe to transmit the resistance heat to the outer metallic pipe;

an inner insulator disposed between the resistance heating body and the inner metallic pipe, wherein the inner insulator is thicker than the outer insulator; and a resin film between the outer insulator and the outer metallic pipe.

35. The fusing roller of the image forming apparatus of claim 34, wherein the outer metallic pipe is coated with a synthetic resin so that a coating layer is formed around an outer circumference of the outer metallic pipe.

36. The fusing roller of the image forming apparatus of claim 34, further comprising an end cap and a gear cap respectively connected to both ends of the outer metallic pipe and electrically connected to the resistance heating body.

37. The fusing roller of the image forming apparatus of claim 34, wherein the resistance heating body is approximately 0.1 mm in thickness.

38. A fusing roller of an image forming apparatus comprising:

an outer metallic pipe;

an inner metallic pipe disposed inside the outer metallic pipe;

a resistance heating body disposed between the outer and the inner metallic pipes, generating a resistance heat;

an outer insulator interposed between the resistance heating body and the outer metallic pipe to transmit the resistance heat to the outer metallic pipe; and an inner insulator disposed between the resistance heating body and the inner metallic pipe, wherein;

the inner insulator is thicker than the outer insulator, and the inner insulator includes a first insulating sheet, a second insulating sheet, and a third insulating sheet that are consecutively layered from the resistance heating body toward the inner metallic pipe with a predetermined thickness.

39. The fusing roller of the image forming apparatus of claim 38, wherein the outer metallic pipe is coated with a synthetic resin so that a coating layer is formed around an outer circumference of the outer metallic pipe.

40. The fusing roller of the image forming apparatus of claim 38, further comprising an end cap and a gear cap respectively connected to both ends of the outer metallic pipe and electrically connected to the resistance heating body.

41. The fusing roller of the image forming apparatus of claim 38, wherein the resistance heating body is approximately 0.1 mm in thickness.

42. A fusing roller of an image forming apparatus comprising:

an outer metallic pipe;

an inner metallic pipe disposed inside the outer metallic pipe;

a resistance heating body disposed between the outer and the inner metallic pipes, generating a resistance heat;

an outer insulator interposed between the resistance heating body and the outer metallic pipe to transmit the resistance heat to the outer metallic pipe; and an inner insulator disposed between the resistance heating body and the inner metallic pipe, wherein;

the inner insulator is thicker than the outer insulator, and the thickness of the inner metallic pipe is approximately half the thickness of the outer metallic pipe.

43. The fusing roller of the image forming apparatus of claim 42, wherein the outer metallic pipe is coated with a synthetic resin so that a coating layer is formed around an outer circumference of the outer metallic pipe.

44. The fusing roller of the image forming apparatus of claim 42, further comprising an end cap and a gear cap respectively connected to both ends of the outer metallic pipe and electrically connected to the resistance heating body.

45. The fusing roller of the image forming apparatus of claim 42, wherein the resistance heating body is approximately 0.1 mm in thickness.

* * * * *

UNITED STATES PATENT AND TRADEMARK OFFICE

CERTIFICATE OF CORRECTION

PATENT NO. : 7,024,146 B2
APPLICATION NO. : 10/642759
DATED : April 4, 2006
INVENTOR(S) : Hwan-guem Kim et al.

It is certified that error appears in the above-identified patent and that said Letters Patent is hereby corrected as shown below:

Column 6, line 27: after “wherein” delete “;” and insert --:-- therefor.

Column 6, line 35: after “claim 1” insert --,--.

Column 6, line 67: delete “25μpm” and insert --25μm-- therefor.

Column 7, line 24: after “wherein” delete “;” and insert --:-- therefor.

Column 7, line 59: after “wherein” delete “;” and insert --:-- therefor.

Column 8, line 59: after “wherein” delete “;” and insert --:-- therefor.

Column 9, line 9: after “wherein” delete “;” and insert --:-- therefor.

Column 10, line 17: after “wherein” delete “;” and insert --:-- therefor.

Column 10, line 49: after “wherein” delete “;” and insert --:-- therefor.

Signed and Sealed this

Fifteenth Day of August, 2006

JON W. DUDAS
*Director of the United States Patent and Trademark Office*